United States Patent [19]

Vaerk et al.

[11] 4,337,601

[45] Jul. 6, 1982

[54] HIGH-STRENGTH LIGHT-WEIGHT BOOM SECTION FOR TELESCOPIC CRANE BOOM

[75] Inventors: Lembit Vaerk; Narahari Gattu, both of Cedar Rapids, Iowa

[73] Assignee: Harnischfeger Corporation, West Milwaukee, Wis.

[21] Appl. No.: 143,496

[22] Filed: Apr. 24, 1980

[51] Int. Cl.[3] ..... B66C 23/06

[52] U.S. Cl. ..... 52/118; 52/632; 52/731; 212/266

[58] Field of Search ..... 52/118, 632, 731; 212/266

[56] References Cited

U.S. PATENT DOCUMENTS

| | | | |
|---|---|---|---|
| 3,890,757 | 6/1975 | Lamer et al. | 52/731 X |
| 4,003,168 | 1/1977 | Brady | 52/731 X |
| 4,016,688 | 4/1977 | Tiffin et al. | 52/731 X |
| 4,027,448 | 6/1977 | Tymciurale | 52/632 |
| 4,045,936 | 9/1977 | Sterner | 52/632 |
| 4,112,649 | 9/1978 | Fritsch et al. | 52/731 |
| 4,134,236 | 1/1979 | Ott | 52/632 X |
| 4,257,201 | 3/1981 | Lundolt et al. | 52/632 X |

*Primary Examiner*—Carl D. Friedman
*Attorney, Agent, or Firm*—James E. Nilles

[57] ABSTRACT

A high-strength light-weight hollow boom section for a multi-section telescopic crane boom comprises a top wall, a bottom wall, and a pair of lateral walls, each lateral wall being located between the top wall and the bottom wall. Each of the four walls comprises a pair of spaced apart longitudinally extending members, a relatively thin plate extending between, overlapping and welded to the pair of longitudinal members, and a plurality of longitudinally spaced part transversely extending stiffeners of U-shaped cross-sections, each stiffener being welded to the plate and to the pair of longitudinal members. Each longitudinal member of a lateral wall is in edge-wise abutting relationship with and welded to the surface of a longitudinal member of one of the top and bottom walls. Each stiffener of a lateral wall also has its ends in abutting relationship with and welded to the surface of a longitudinal member of the top and bottom walls. Novel slide pad arrangements are also disclosed.

16 Claims, 26 Drawing Figures

HIGH-STRENGTH LIGHT-WEIGHT BOOM SECTION FOR TELESCOPIC CRANE BOOM

BACKGROUND OF THE INVENTION

1. Field of Use

This invention relates to the construction of high-strength light-weight hollow boom sections for multi-section telescopic crane booms.

2. Description of the Prior Art

Mobile cranes are required to have telescopic booms which can handle increasingly heavier loads and raise them to greater heights. It is known to increase boom sizes for load-handling capability, and increase strength by enlarging the physical size of such telescopic booms. As the boom sections increased in size, and as the lengths to which they can be extended are increased, the booms become extremely heavy and more difficult to operate. Various approaches in boom design and construction have been employed to achieve greater size and strength without suffering undue weight penalties. For example, lattice-type booms are sometimes employed and attempts have been made to lighten the boom by piercing holes in the heavy gauge sheet steel of which some boom sections are fabricated. Also, designs employing optimum selection and arrangement of boom section components have been employed to achieve high strength versus weight ratios.

A constant effort has been made to improve a cantilever boom design in the hydraulic crane industry, the emphasis being on the optimum strength. State regulations in the United States impose a weight limit on the vehicles travelling the roads and highways. Construction industry, on the other hand, demands higher reach and lift capacities. Prior art designs show that several manufacturers have developed crane booms with thin side plates and with vertical or longitudinal stiffeners trying to reduce the weight to keep the larger cranes roadable without a special permit. Most common booms, however, have been rectangular four-plate type in cross-section. This design is economical and quite adequate for smaller cranes; however, when the increase capacity and longer booms are required, the height of the boom sections will increase with increase in section properties. At increasing heights, thin side plates without stiffeners have to be considerably thicker in order to protect against shear buckling, thus adding to the weight of the boom.

Typical prior art boom sections comprise rectangular, trapezoidal or triangular cross sections. Very often, in sections wherein the top, bottom and side walls are made of steel plate, high strength structural steel about 3/16 of an inch thick is the minimum thickness in the walls to obtain acceptable performance in respect to shear buckling, tensile, compressive stresses. To further increase the shear buckling capabilities of the boom sections, stiffeners are generally welded to the boom walls. To accommodate sliding between the adjacent boom sections, bearing pads of various materials and configurations are used, such as rollers, bearings, Teflon slide of bearing pads. For practical design reasons, pads are limited in size. And, since the bearing loads are high and the load bearing surface is small, bearing pads are subject to high compressive stresses. Therefore, high wear occurs and thus adjustment means are required to maintain proper clearance between the boom sections.

An example of the prior art is shown in U.S. Pat. No. 4,112,649 issued Sept. 12, 1978 to Fritsch, and which has been assigned to an assignee common with the present invention. That patent utilized longitudinal stiffeners which were bent up fabrications and located along the upper and lower edges of the side walls only. Vertical side stiffeners were generally U-shape or welded to each side of the boom section and also welded to the inner edges of the corner stiffeners. The top and bottom walls were plain and simply abutted against the side walls and their stiffeners.

Other examples of the prior art are the U.S. Pat. Nos. 3,789,563 of Feb. 5, 1974 which discloses the use of two opposed rigid metal extrusions forming upper and lower sides of the boom securely locked in interengagement with side walls; 4,016,688 of Apr. 12, 1977 which discloses the use of right angle steel panels for the purpose of reinforcing the plates which form the sides of the boom; 4,045,936 of Sept. 6, 1977 which shows I-beam side walls for a boom having a thin web with stiffeners for reinforcement along the edges trusses and stiffeners are located interiorly of the beam flanges; and 4,171,598 of Oct. 23, 1979 which utilizes corner angles formed by a rectangular corner member which is overlapped by a double wall.

The West German Pat. No. 2,205,093 of 1973 shows a number of hollow box sections having lengthwise protrusions from the side webs and by which it is supported on rollers. The protrusions are situated on their respective webs in the tension zones above the neutral axis. The East German Pat. No. 31498 of 1964 also shows various corner reinforcements for web sections in a boom.

SUMMARY OF THE PRESENT INVENTION

In accordance with the present invention, there is provided a large high-strength light weight telescopic crane boom which comprises a plurality of relatively movable hollow boom sections, such as a base, intermediate, outer and fly sections. Each boom section comprises a top wall, a bottom wall, and a pair of lateral walls between the top wall and the bottom wall. Each of the four walls comprises a pair of spaced apart longitudinally extending members or edge portions, a relatively thin plate portion extending between and joined, as by overlapping and welding (or integral formation), to the pair of longitudinal members or edge portions, and a plurality of longitudinally spaced apart transversely extending stiffeners of U-shaped cross-sections, each stiffener being welded to the plate portion and to the pair of longitudinal members or edge portions. Each longitudinal member or edge portion of a lateral wall is in edge-wise abutting "T" relationship with and welded to the surface of a longitudinal member or edge portion of one of the top and bottom walls. Each stiffener of a lateral wall also has its ends in abutting relationship with and welded to the surface of a longitudinal member or edge portion of the top and bottom walls. In a preferred embodiment, the plate portion of each top wall and bottom wall is disposed near the top or above the longitudinal members or edge portions of its respective wall and the stiffeners are disposed below said plate portion. Furthermore, the plate portion of each lateral wall is disposed near the inside or inwardly of the longitudinal members or edge portions of its respective wall and the stiffeners are disposed outwardly of the plate portion. Each plate portion is substantially thinner than the longitudinal members or edge portions to which it is joined, as by welding or integral information. With the present invention there are several advantageous features over the prior art. For example, thin plates and stiffeners are not only used on the boom sides, but also on top and bottom. Heavy mass is concentrated in the section corners, thus affording the largest mechanical section properties possible with the same use of metal. The stiffness of the corners is large compared to other elements in the section, thus minimizing the entire boom deflection in vertical and horizontal planes. The forces of contact are deliberately directed through the corner structure which has a higher rigidity, thus providing a better protection against failure due to local buckling and high local stress. In addition, the fully extended boom will experience lesser deflections at the contact point. Furthermore, each boom section is extremely light and strong in proportion to its physical size because of the use of relatively thin plates in each of the four walls. The longitudinal members forming the edges of each wall are joined to their respective plates by two continuous welds, which together with the fact that the longitudinal edge members are substantially thicker than the side, bottom and top plates, although much smaller in overall areas, contributes to high strength and low weight. The use of generally U-shaped light-weight stiffeners at intervals along each boom section wall also contributes to high strength and low weight.

Each longitudinal member in each side wall is secured in abutting relationship to the face of a longitudinal edge member in the top or bottom wall by two continuous welds. A boom section of such construction lends itself to the use of relatively lower cost raw materials which do not require unduly complex, costly or time-consuming preparation or pre-fabrication before being incorporated in the boom section. Furthermore, the materials employed and the nature of the boom construction enable relatively economical but more effective and strong welding techniques to be employed.

Other objects and advantages will hereinafter appear.

DESCRIPTION OF A PREFERRED EMBODIMENT

General Arrangement

Figure 1:
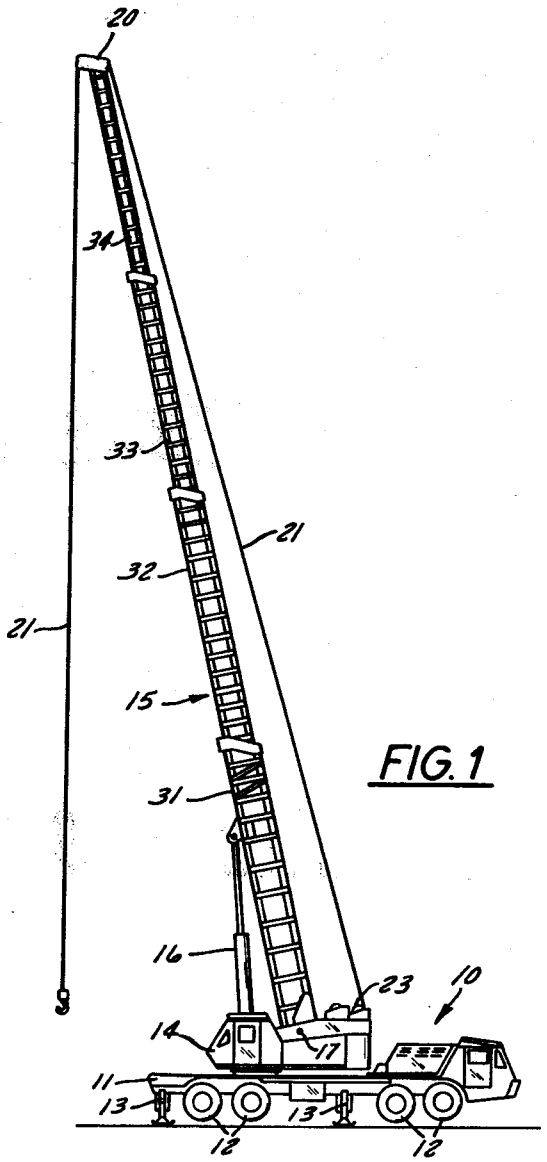
FIG. 1 is a side elevational view of a mobile crane having a telescopic boom employing boom sections in accordance with the present invention and showing the telescopic boom raised and fully extended.

Referring to FIG. 1 of the drawings, the numeral 10 designates a mobile crane in accordance with the invention. Crane 10 comprises a carrier frame 11 having ground-engaging wheels 12, extendable and retractable outriggers 13 (shown fully extended), and a rotatable crane upper 14 mounted thereon. Crane upper 14 comprises a telescopic boom 15 which is understood to be pivotable in a vertical plane by means of a boom hoist cylinder 16 about a trunnion 17. Boom 15 has a load hoist line sheave assembly 20 at its point end **40*a* for supporting a load hoist line 21 which is connected to a hoist drum 23 on crane upper 14**.

Figure 2:
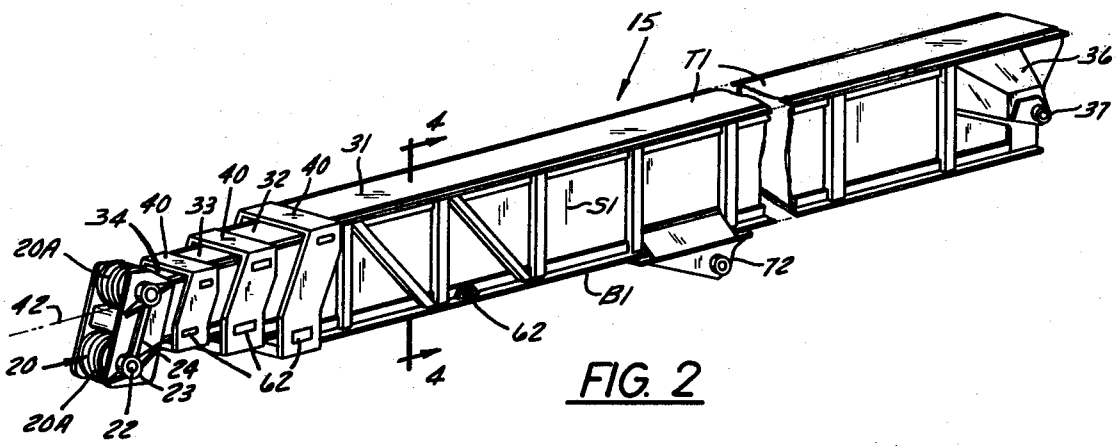
FIG. 2 is an enlarged, perspective view of the telescopic boom of FIG. 1 and showing it as removed from the crane, lowered and fully retracted.
Figure 3:
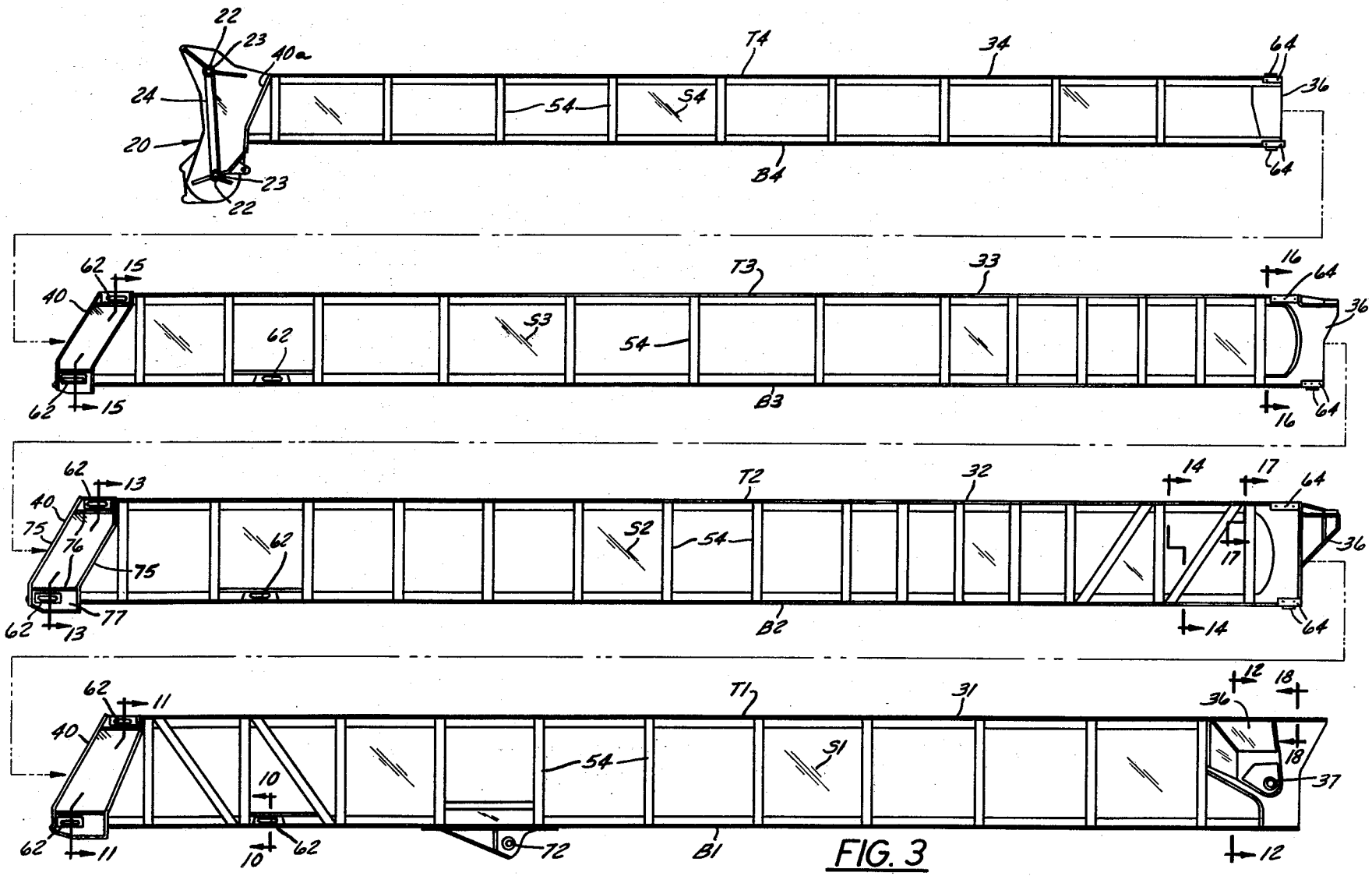
FIG. 3 is an exploded, elevational view showing the boom sections of the telescopic boom of FIGS. 1 and 2 fully separated from one another.

As FIGS. 1 through 4 show, boom 15, which is constructed in accordance with the invention, comprises a plurality of boom sections of hollow rectangular cross-section, namely, a boom base section 31, an intermediate section 32, and outer section 33, and a fly section 34, each of progressively smaller transverse cross-section so that they are telescopable, one within another. FIG. 2 shows boom 15 fully retracted and FIG. 1 shows it raised and fully extended. FIG. 3 shows the boom sections 31, 32, 33 and 34 separated from one another so that they can be compared.

As FIG. 3 shows, each boom sections 32, 33 and 34 is provided at its inner end with a support plate bracket structure 36 on the inside surfaces of opposite sides thereof. The structure 36 on base boom section 31 is exteriorly located and has a trunnion support 37 secured thereto for supporting trunnion 17 by means of which boom section 31 is pivotally mounted on crane upper 14, as FIG. 1 shows.

Each sections 31, 32 and 33 is also provided at its outer end with a support or collar structure 40. Fly section 34 includes on its outer end a boom point **40*a* which is defined by portions of the hoist line sheave assembly 20 shown in FIGS. 1 and 2**.

Figure 4:
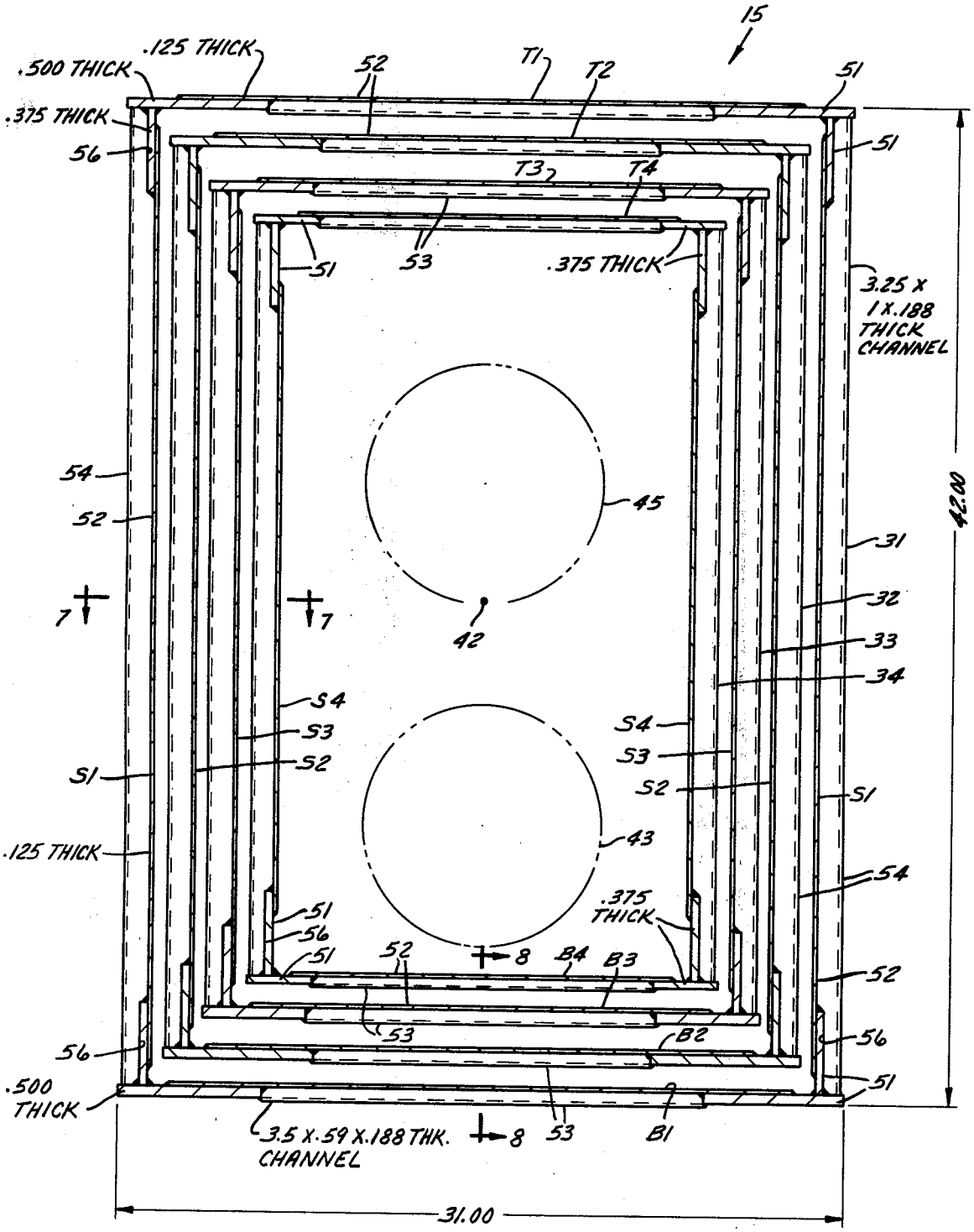
FIG. 4 is an enlarged, cross-sectional view of the boom taken on line 4—4 of FIG. 2.

As FIGS. 2, 3 and 4 show, telescopic crane boom 15 has a longitudinally extending horizontal neutral axis 42 which extends through base section 31 and the other movable sections 32, 33, and 34, which are telescopically receivable within the base section. Hydraulic cylinders 43 and 45, shown in FIG. 4 are located within boom 15 and are operable for telescopically extending and retracting the movable sections 32 and 33 relative to each other and to the base section 31. Section 34 is manually operable in a conventional manner.

The boom sections 31, 32, 33, 34 comprise top walls T1, T2, T3, T4, respectively; bottom walls B1, B2, B3, B4, respectively; and pairs of spaced apart side walls S1, S2, S3, S4, respectively.

Since the high-strength light weight hollow boom sections 31, 32, 33, 34 for the multisection telescopic crane boom 15 are generally similar in configuration and construction, except as to size and the dimension of certain components, only boom section 31 is hereinafter described in detail, except as otherwise noted.

As FIGS. 1 through 6 show, boom section 31 comprises a top wall T1, a bottom wall B1, and a pair of lateral walls S1. Each of the four walls T1, B1 and S1 comprises a pair of spaced apart longitudinally extending members or solid bars 51, a relatively thin plate 52 extending between, overlapping and welded to the pair of longitudinal members 51, and a plurality of longitudinally spaced apart transversely extending stiffeners 53 (or 54) or U-shaped cross-section, each stiffener 53 (or 54) being welded to the plate 52 and to the pair of longitudinal members 51. Each longitudinal member 51 of a lateral wall S1 is in edge-wise vertical abutting "T" relationship with and welded to the surface of a vertical longitudinal member 51 of one of the top and bottom walls T1 and B1, respectively. Each stiffener 54 of lateral walls S1 also has its ends in abutting relationship with and welded to the surface of a longitudinal member 51 of the top and bottom walls T1 and B1, respectively.

Figure 6:
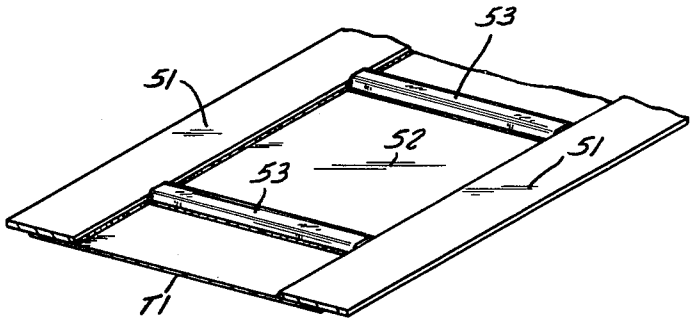
FIG. 6 is a perspective view of the bottom side of the top wall shown in FIG. 5.
Figure 5:
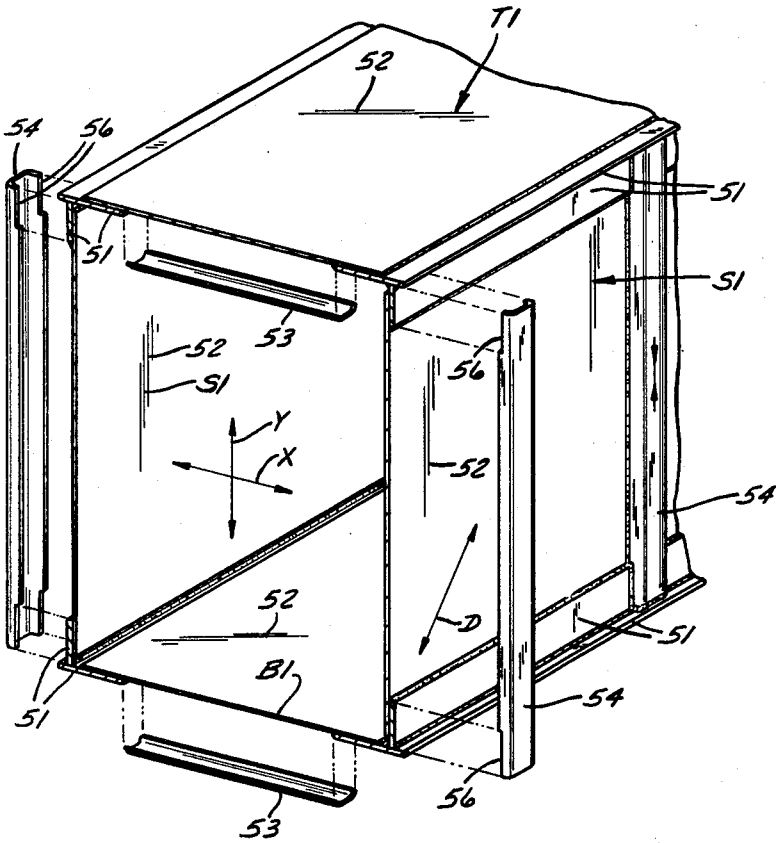
FIG. 5 is a perspective view of an end of a cut-through boom section in accordance with the invention.
Figure 8:
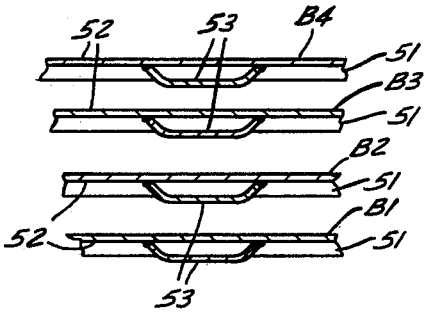
FIG. 8 is an enlarged, cross-sectional view taken on line 8—8 of FIG. 4.

As FIGS. 4, 5 and 6 show, each plate 52 is substantially thinner than the longitudinal members 51 to which it is welded. As FIGS. 4, 5, 7 and 8 show, at least some, and preferably all of the stiffeners 53 and 54, have a generally U-shape cross-sectional configuration. FIGS. 4, 5 and 6 show that the plate 52 of the top wall T1 and the bottom wall B1 is disposed above the longitudinal members 51 of its respective wall and FIGS. 4, 5 and 8 show that the stiffeners 53 or the respective wall are disposed below the plate 52.

FIGS. 4 and 5 show that the plate 52 of each of the lateral walls S1, S2, S3 and S4 are disposed inwardly of the longitudinal members 51.

As FIGS. 4 and 5 best show, each lateral wall stiffener 54 is provided with notches or cut-outs 56 near its opposite ends to accommodate or clear the longitudinal members 51 of its associated lateral walls S1.

In the following portions of the specification preferred certain structural features and characteristics of the present invention are described in detail.

Corner "T" Sections and Thin Plate Panels

In order to obtain the optimum section properties with minimum material, the bulk of the mass should be distributed as far distant as possible from the section neutral axes. For the long booms 15 which support a lattice boom extension (not shown), plus a lattice jib (not shown), high section properties in the Y direction (see FIG. 5) are equally important as the section properties in the X direction. In fact, the side loads caused by wind eccentricity, rotating mass above the slewing ring (not shown) of crane upper 14 (assumed 3 percent of total load in U.S. for test purposes) are frequently the determining factors for extended boom lift capacities in large elevation angles.

In the present invention, the mass in the corners of the boom section was formed from two heavy, solid bars or members 51, secured by welding, so the combination formed a "T" section. The "T" section can be tailored to needed properties for any size of boom and to either "Y" or "X" axis direction (see FIG. 5) whatever the actual design dictates. The heavy "T" corners are connected on all four sides with the thin plate 52 (0.125 inches thick, for example), subsequently forming a rectangular box structure.

However, the thin plate 52 connecting the corner "T" 's would be unstable by itself so it is reinforced by stiffeners 53, 54 all around the structure (see FIGS. 4 and 5). These stiffeners 53, 54 are placed on outside of the boom section on the side walls S1 and on the bottom wall B1, but welded inside of the top wall T1. The spacing of the stiffeners is such as to form equal panels around the section periphery. The panel size depends on the varying shear loading which will be explained hereinafter. Paneling of this type is analogous to a truss with diagonal "X" lacing at all sides connecting straight struts on top, bottom and sides. This structure is extremely rigid in torsion because the thin plate 52 will resist diagonal tension as one of the "X" laces and thus prevent the rotation of joints longitudinally, changing the tension band direction with the direction of torsional moment. The same analogy can be extended to the top and bottom panels when a side load is applied.

The corner "T" sections described previously run the entire length of the individual boom sections. As FIGS. 3, 4 and 5 show, each horizontal bar 51 is usually somewhat heavier and wider than the vertical bar 51, and it provides the support surface for most of the top, bottom and side slider pads, hereinafter described. It also contributes to increase in section properties in the "Y" direction. Vertical bar 51 in the "T" joint acts as a longitudinal stiffener, helps to increase the side section properties and provides necessary rigidity to prevent the thin side plate 52 from buckling under local uniform loads imposed by the slider pads. Moreover, the nature of the boom section as a whole is influenced by the bending stiffness of the corners. The corner stiffness helps to form more uniform and wider tension field bands in the thin side plate.

Contrary to other known prior art designs, the side stiffeners 54 in the present arrangement are welded transversely to the vertical bar of the "T" joint in such a manner as to provide more fixity for the corner or prevent rotation (see FIG. 5). The stiffeners 53 on the top and bottom walls do not overlap the horizontal corner plate 51 but are butt welded to it. In addition, they serve also as spacers to retain the dimensional stability while the heavy plates carry essentially the main beam load.

Thin Plate Design With Transverse Stiffeners

In order to control and improve the weight to strength ratio of a structure that is loaded as a beam or beam column, a relatively thin plate 52 (relative to the thicker plate 51) has been used for the side walls S1 with deliberately spaced transverse stiffeners 54. By making the top and bottom walls thicker than the lateral side walls, greater moment of inertia and section modulus in a vertical direction is provided. When the critical buckling in the thin side plate 52 is reached, the side plate does not collapse but serves as a tension diagonal (see diagonal arrow D in FIG. 5) and the stiffeners become compression struts. Since a flat sheet is very efficient in tension, the actual side plate buckling opposite diagonally causes stress redistribution, and if the top and bottom plates and the stiffeners can resist the increased loading, the beam will not fail.

Conforming to the present invention, the aforedescribed analysis is utilized for the side plates 52. The thin plates 52, however, are also used on the top and bottom to connect more massive corner "T"'s. The top and bottom plates 52 are reinforced with stiffeners 53 whose centerlines coincide with the stiffeners 54 on the side, thus forming evenly spaced panels around the bottom section periphery (FIG. 4, for example).

Shear Loads and Transverse Stiffener Spacing

Figures 1, 6A:
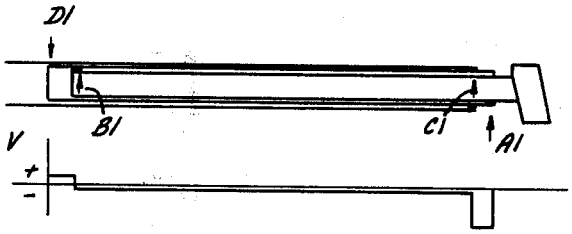
FIG. 6A depicts graphically how shear loads determine stiffener spacing.
Figures 2, 6A:
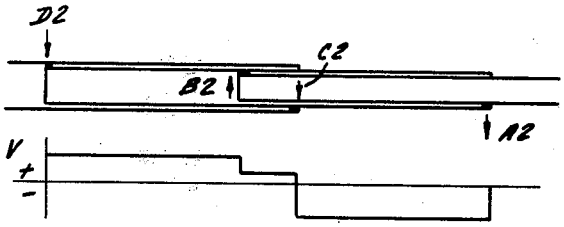
Figures 3, 6A:
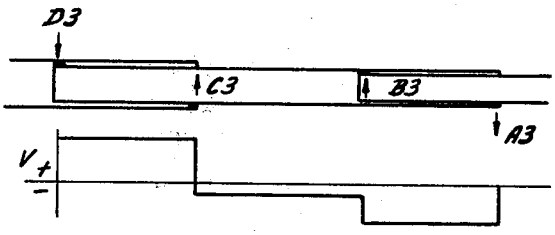
Figures 4, 6A:
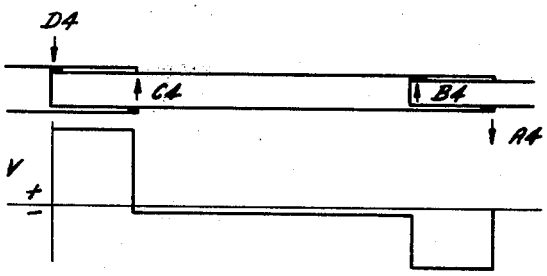
Figures 5, 6A:
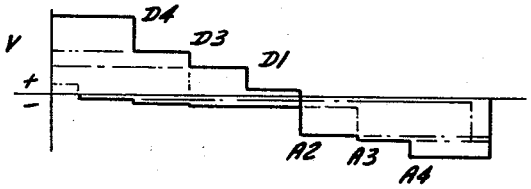
Figures 6, 6A:
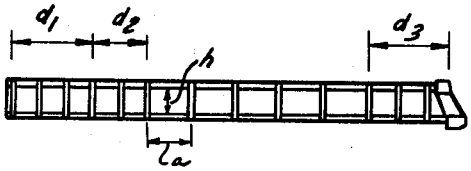
Figure 7:
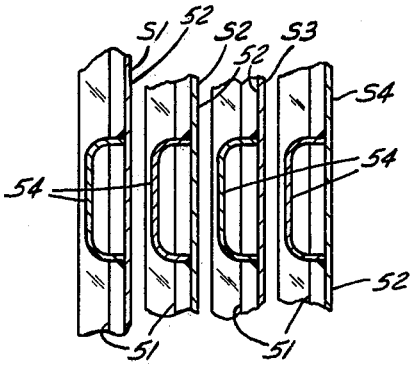
FIG. 7 is an enlarged, cross-sectional view taken on line 7—7 of FIG. 4.

Most known booms that have been manufactured utilize equal stiffener spacing throughout one boom section. To save further weight, in the present invention, the side stiffener 54 spacing is directly related to the magnitude of the shear. However, as FIG. 6A shows, the shear is variable throughout the telescoping boom loading cycle, and consequently the maximum shear load diagrams must be plotted for one section under all telescoping boom lengths (see FIGS. 6A-1 through 6A-5 which show how the stiffener 54 spacing can be calculated for corresponding loads). Inasmuch as the shear capacity is increasing with the closely spaced stiffeners (a/h ratio decreases), the stiffener spacing is regulated basically for the following positions: namely, for the rear overlap, see FIG. 6A-6, $d_1$, and for front overlap, $d_3$ on the same Figure. The spacing in the middle of the section is kept uniform and calculated for maximum shear from the super-position diagram (FIG. 6A-6).

On the other hand, the reaction at distance $d_2$ (see FIG. 6A-4) is usually larger than the shear at the rear overlap. The bottom plate here is subjected to heavy uniform transverse loads where the slide pads, described below, contact the section corners. This condition superimposes additional local stress to the normal beam stress and the combination of stresses might get high enough to buckle the side plate 52 vertically. The most critical location for this stress combination is the middle of the panel between the stiffeners. For this purpose, the stiffener spacing in this region is held closer until the reaction magnitude by retracting the boom drops to a safe level (see FIG. 6A-6).

Slider Pads

Figure 17A:
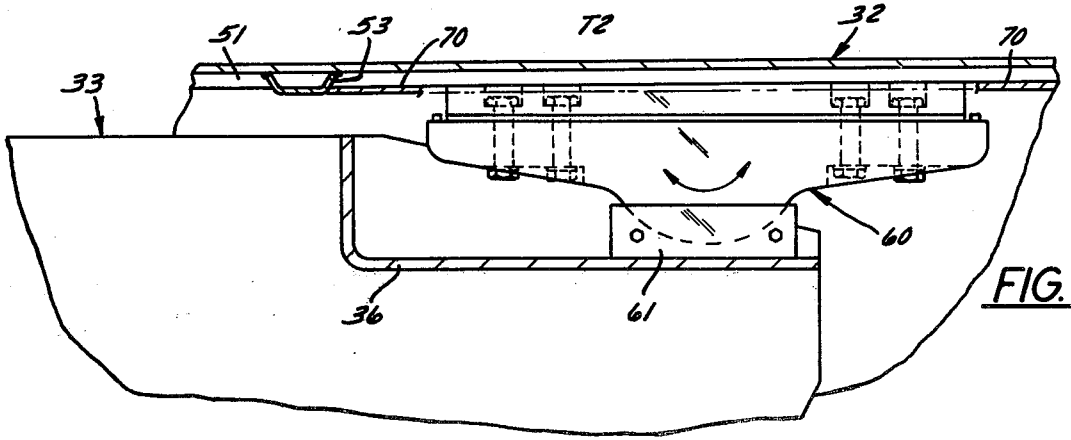
FIG. 17A is a cross-sectional view of a pivotable slide pad shown in FIG. 17, and taken on line 17A—17A thereof.
Figure 17:
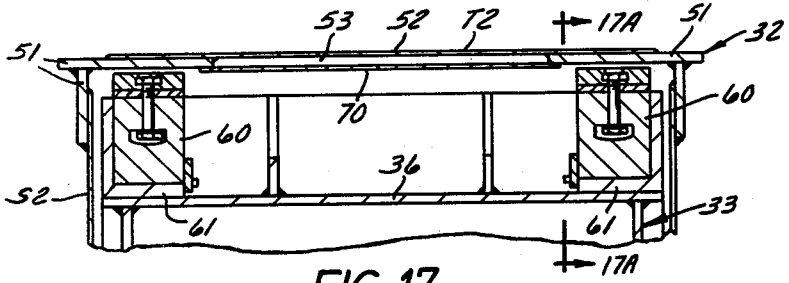
Figure 18:
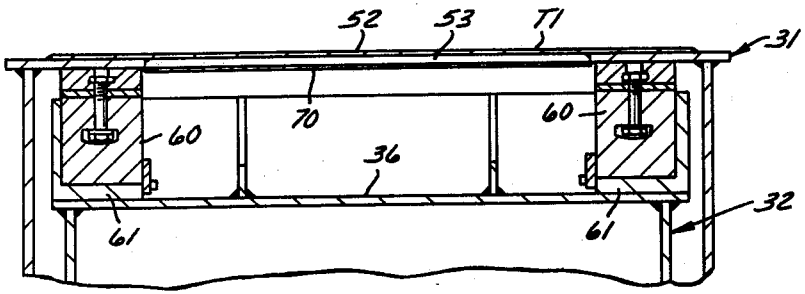

As FIGS. 9 through 18 show, top, bottom and side slider pads are provided. As FIGS. 11, 13, 17 and 18 show, top and bottom slider pads 60 are constructed so that they can rotate longitudinally in the direction of boom 15 in specially designed rocker sockets 61 (see FIGS. 17 and 17A). This arrangement insures full contact of the slider pads 60 when the boom sections deflect under heavy loading. Usually, prior art type slider pads cause local transverse bending stresses on the top and bottom plates of a boom section. In FIGS. 17 and 17A, the pads 60 are relatively narrow and long, act on the wider rigid surfaces of the horizontal corner "T" bars 51. The load distribution of these pads 60 is considerably better than those used in previous designs. In fact, the local deflection on slider pad contact surface is minimized and thus contributes to the longitudinal stability of the entire boom 15.

There are five slider pads for the side support of each boom section, three of which, designated 62 in FIGS. 9–18, are made of bronze aluminum alloy and react on the top and bottom outer edges of their associated horizontal "T" bars 51 of the next inner section. The bronze aluminum alloy slide pads 62 are extremely wear resistant, have good anti-friction properties and are free to float in deep pockets in the sockets 63 to compensate for the possible misalignment during the telescoping cycle of boom 15.

Two of the pads, designated 64 on each side are Nylatron TM and are fastened on the rear, top and bottom wall of each boom section and slide on the vertical bar 51 of the corner structure. Two additional slide pads 64 are mounted on the bottom of the rear horizontal bars 51 to react on the corner of its next associated boom section. As FIG. 10 best shows, most of the slider pads 62 are provided with double adjustment means, such as set screws 65 and shimming 66. Six slider pads 62, three on each side of a boom section, are adjustable from outside of the boom of base section 31, thus facilitating the side alignment of boom after assembly. A collar structure 67 to contain and support the slide pads is designed for rigidity to keep local deflection to a minimum as FIGS. 3 and 10 show.

Figure 9:
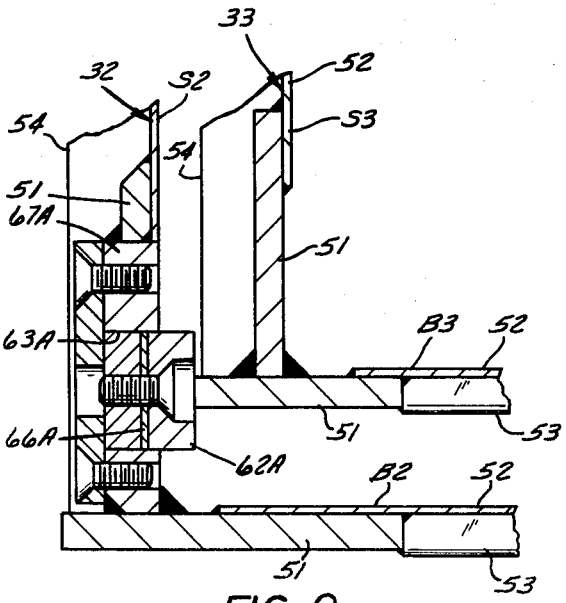
FIG. 9 is a cross-sectional view of slide pad arrangement, but an alternate form from that shown in FIG. 10.
Figure 10:
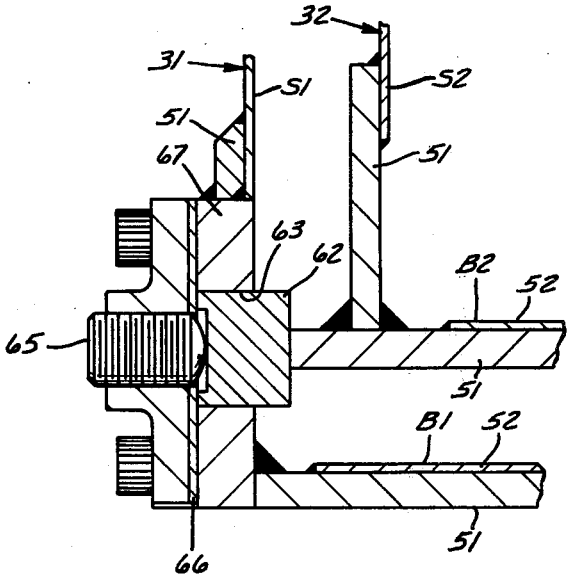
FIG. 10 is a cross-sectional view taken on a correspondingly designated line in FIG. 3.
Figure 12:
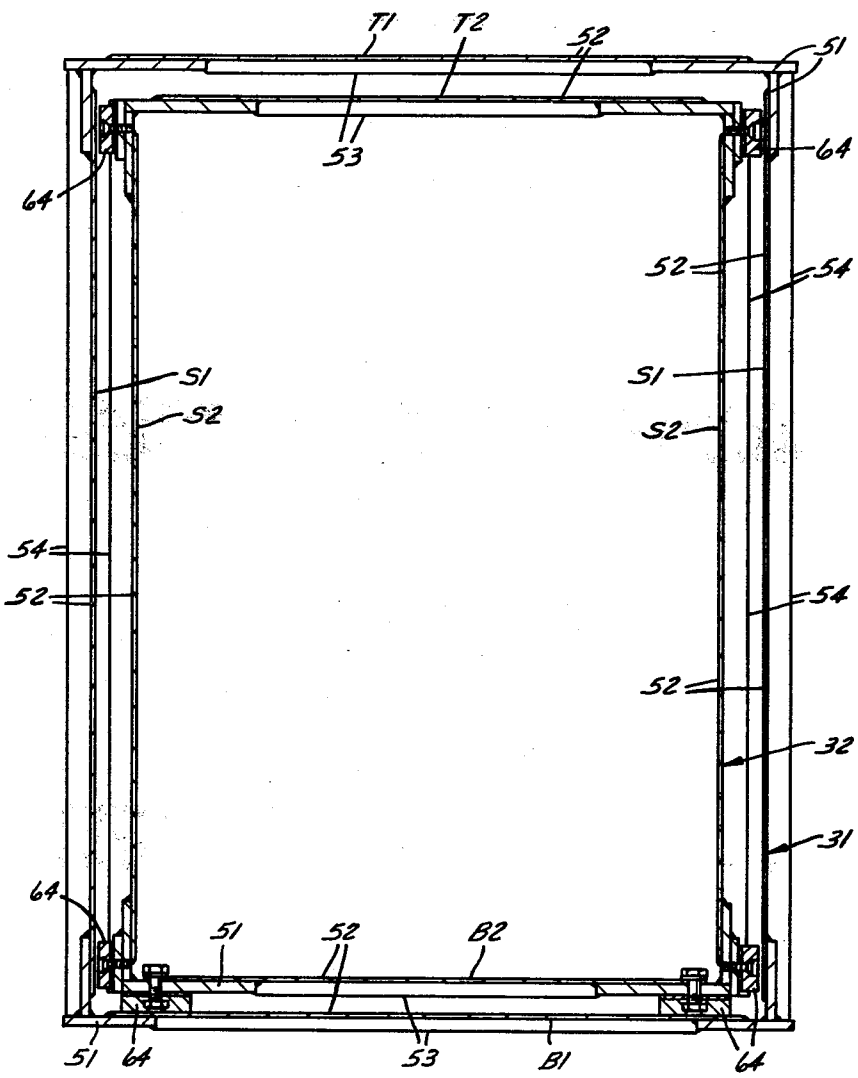
FIGS. 11, 12, 13, 14, 15, 16, 17 and 18 are cross-sectional views taken on correspondingly designated lines in FIG. 3 and further include the next "inner" boom section.
Figure 11:
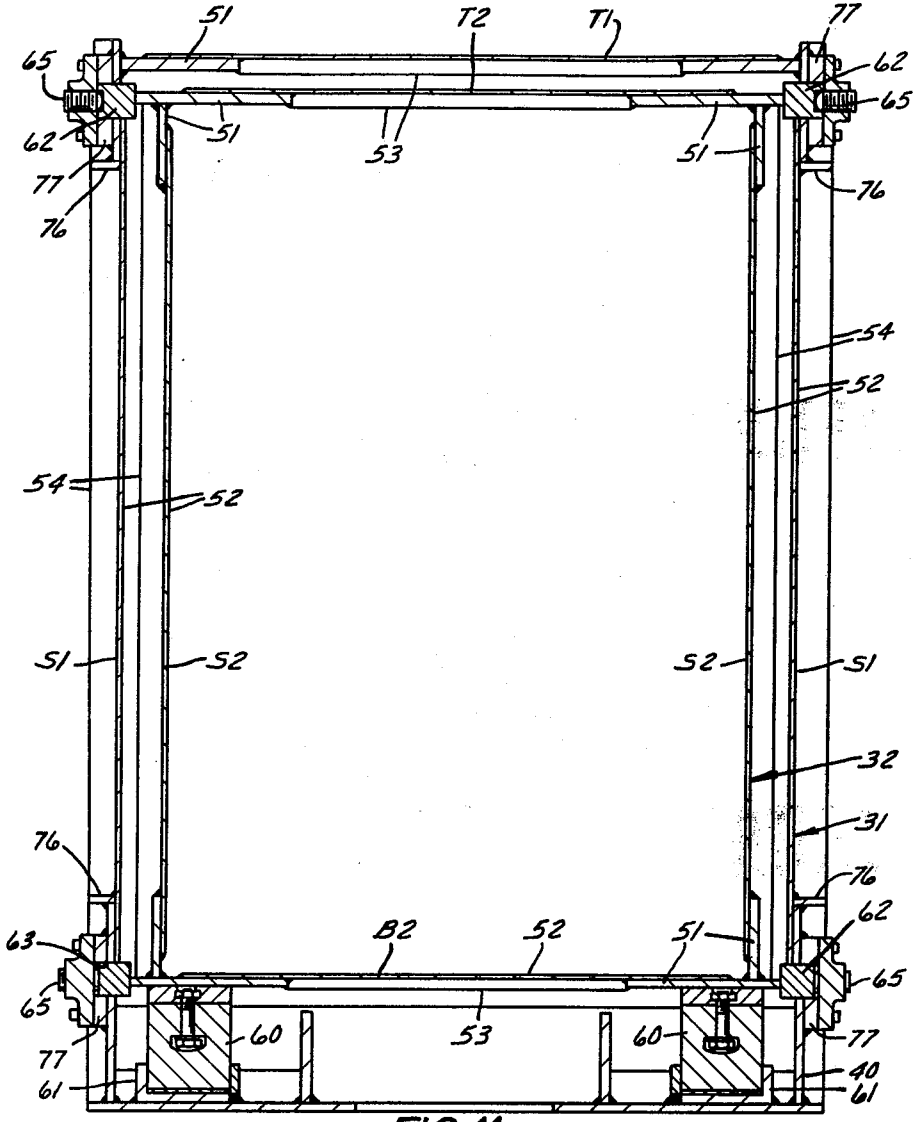
Figure 14:
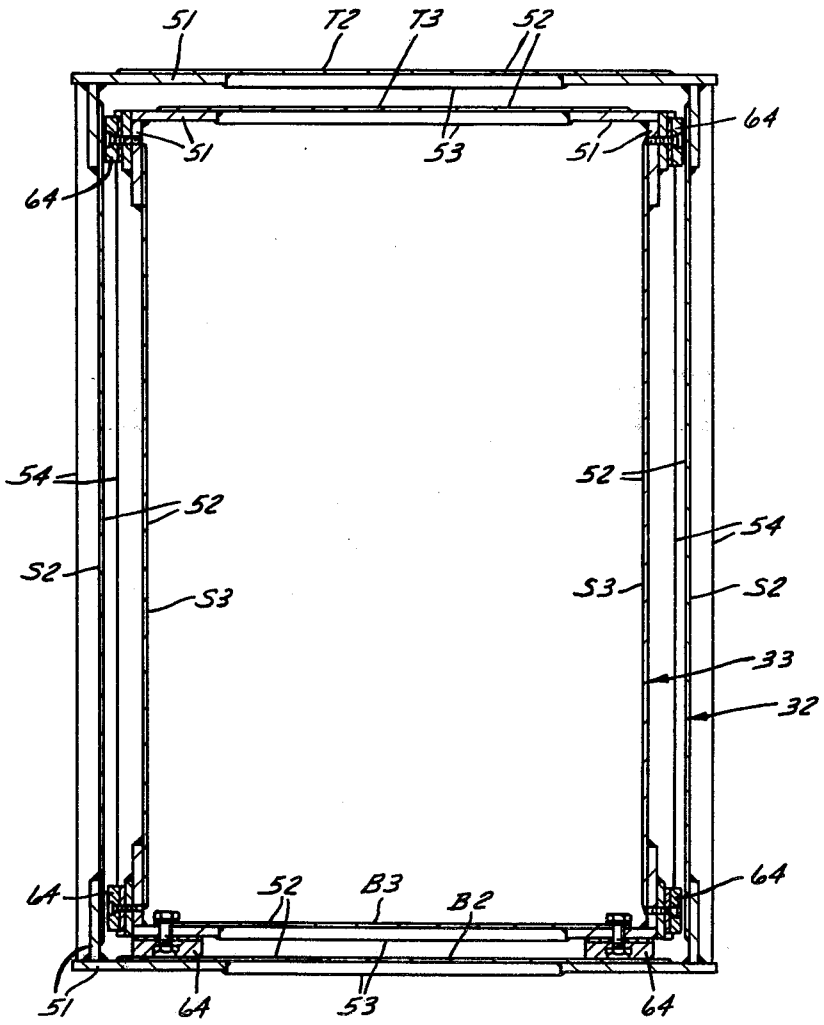
Figure 13:
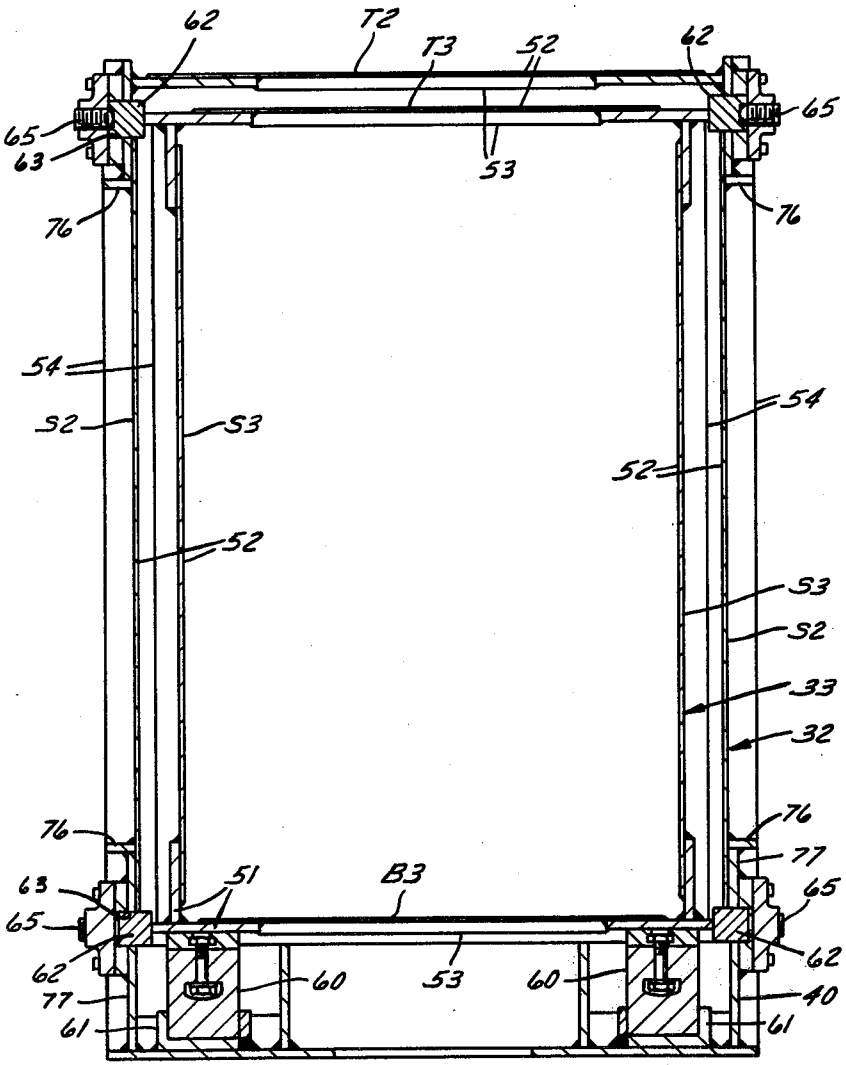
Figure 16:
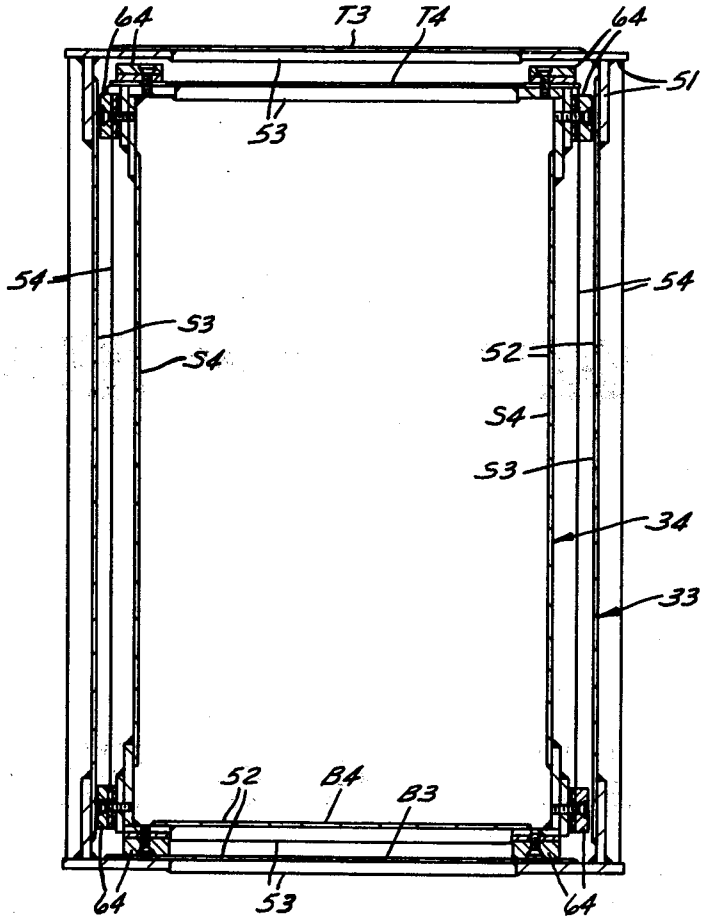
Figure 15:
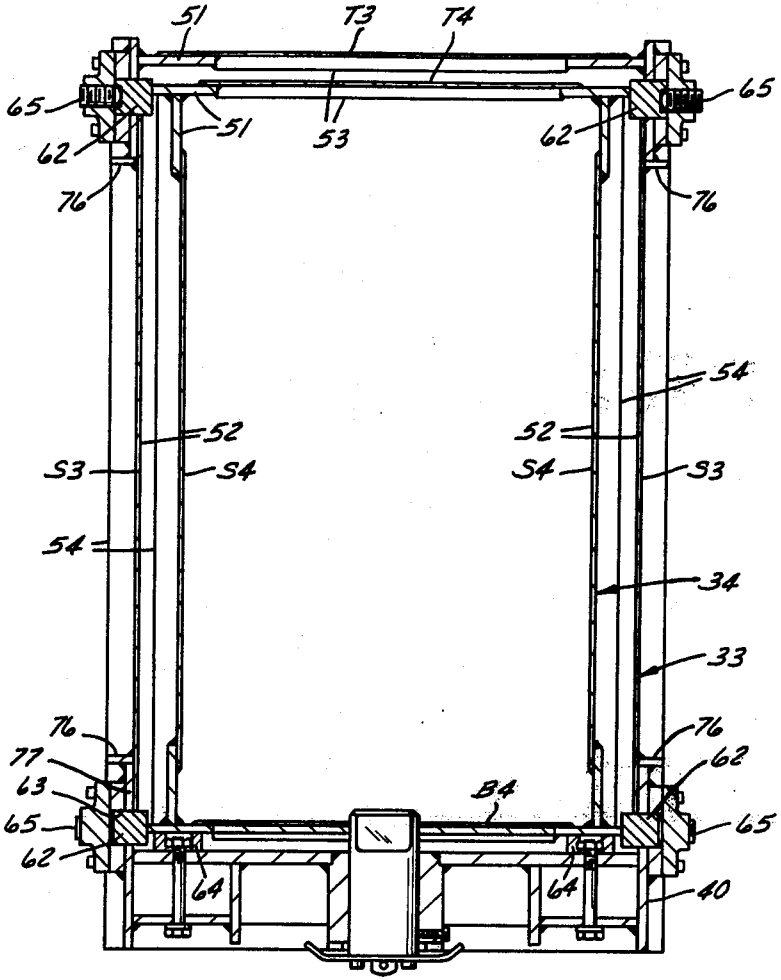

As FIGS. 10 and 11 show, six edge slide pads are also on boom sections 32 and 33. These boom sections utilize four of the aforementioned externally adjustable slide pads 62 housed on their collar structures 40. FIG. 9 shows an alternate non-externally adjustable edge slider pads 62A, which are shimmed during assembly and free to float in sockets 63A or collar structure 67A.

Reinforcement of Top Plate

When the boom 15 is fully extended, the overlaps between sections are shortest as FIG. 6A-4 makes clear. In this configuration, the reaction on the top and bottom slider pads 60 are at their maximum value. The top slider pads 60 cannot be placed as efficiently as the bottom slide pads 60 and are reacting eccentrically to the outer boom section corner. This eccentricity to the outer boom section corner produces a corner moment that causes transverse bending on the top plate and reduces the amount of fixity of the corner (see arrow in FIG. 17). The conventional method to reinforce this region is to add a doubler on the top of the boom section.

In contrast however, in the present invention, the top plate 52 is thin, reinforced with transverse stiffeners 53 that are secured to the thin plate 52 and "T" bars 51 by welding. In a region of high reaction another relatively thin doubler plate 70 is welded to the stiffeners 53 and stop bar 51 inside of the boom section, thus forming a double wall (see FIG. 17). Experiments with the test sections have shown that this structure is quite efficient to restrain the rotation of the "T" corner and lateral deflection of the top plate 52. Furthermore, this method offers significant weight saving over the conventional constructions.

Reduced Bottom Plate for the Base Section

Due to the nature of the base section 31, loading section properties can be reduced (compare FIGS. 2 and 3) behind the hoist cylinder bracket 72 because the bending moment between boom pivot point at trunnion 37 and hoist cylinder 16 connection is significantly less than bending moment toward the collar 40. Secondly, an additional tensile load acts on this portion of the boom section which further reduces compressive stress on the bottom plate 52. One object being weight reduction in the present design, bottom plate 52 can be narrowed in the length between hoist cylinder bracket 72 and boom pivot 37 giving meaningful results in lightening the structure without paying the penalty of excessive stress.

Collar Design

At the front end of intermediate boom sections 32, 33 and at the base section 31, the collar 40 houses the pivotal front bottom slider pads 60 and side slider pads 62 that support the inner telescoping section at the outer edges. All the slider pads are adjustable for wear and for boom alignment. These pads resist the forces caused by inner section and must be extremely rigid in the direction of applied force (see FIGS. 2 and 3). To obtain this rigidity, the collar 40 is provided with two heavy slanted vertical ribs 75 and two horizontal ribs 76 (see FIGS. 11, 13 and 15). Between these ribs a heavy plate 77 is welded containing metal slider pad pockets 63. The depth of a pocket 63 is such that with maximum adjustment, the slider pads still remain in the slot. Strength, however, is not required in the middle of the collar structure 40, so the middle of the ribbing is only connected with thin, i.e., 0.125" thick, plate.

Boom Point

Referring to FIGS. 2 and 4, to assure torsional rigidity of the boom point sections 34, the transition of the end section between the side plates is designed as a closed box. An additional function of the boom point assembly 20 besides housing the sheaves 20A for wire rope 21, is to support an extra long swing-away lattice extension (not shown) which is mountable on the sheave pin ends 22 and has a wide base (48"×36"). Sheave pins 22 are contained in tubular bearings 23 that are welded to the slide plate of the boom point and are reinforced on both sides with formed channel stiffeners 24 (see FIGS. 2 and 3).

Figure 19:
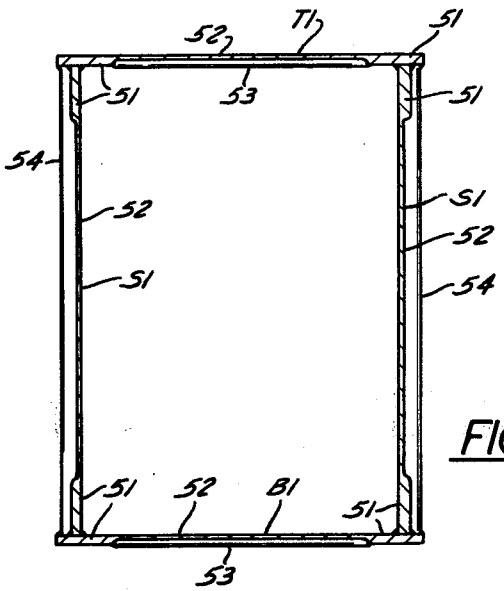
FIG. 19 is a cross-sectional view of an alternative embodiment of a boom section in accordance with the invention wherein some components are integrally formed.

FIG. 19 depicts an embodiment wherein the walls of a boom section in accordance with the invention are shown as comprising a plate portion 52 which is integrally formed with a pair of spaced apart elongated longitudinally extending edge portions 51 which edge portions are relatively thicker than the plate portion 52. This embodiment also employs stiffeners 53 on the top and bottom walls and also employs stiffeners 54 on the lateral or side walls S1. Each of the four walls in this embodiment may, for example, be formed from a single strip of rolled metal so as to provide the cross-sectional configuration shown in FIG. 19. A boom section constructed as shown in FIG. 19 functions in the same manner as the boom section fabricated of discrete components which are welded together as hereinbefore described.

We claim:

1. A high-strength light-weight hollow boom section for a telescopic crane boom comprising:

a top wall, a bottom wall, and a pair of lateral walls between said top and bottom walls;

each of said walls comprising a pair of spaced apart longitudinally extending edge portions, a relatively thinner imperforate plate portion extending between and joined to said pair of edge portions and welding material joining said plate portion to said edge portions;

and each edge portion of a lateral wall being in edge-wise abutting relationship with and joined to an edge portion of said top and bottom walls and welding material joining each edge portion of a lateral wall to an edge portion of said top and bottom walls.

2. A boom section according to claim 1 further including a plurality of longitudinally spaced apart transversely extending stiffeners, and welding material securing each stiffener to said plate portion and to said pair of edge portions.

3. A boom section according to claim 2 wherein each stiffener of a lateral wall also has its end in abutting relationship with and joined to edge portions of said top and bottom walls and welding material joining each stiffener of a lateral wall to edge portions of said top and bottom walls.

4. A high-strength light-weight hollow boom section for a telescopic crane boom comprising:

a top wall, a bottom wall, and a pair of lateral walls between said top wall and said bottom wall;

each of said walls comprising a pair of spaced apart longitudinally extending members, an imperforate plate extending between and overlapping and welded to said pair of members, and a plurality of longitudinally spaced apart transversely extending stiffeners, each stiffener being welded to said plate and to said pair of members by welding material;

each member of a lateral wall being in edge-wise abutting relationship with and welded to a member of one of said top and bottom walls by welding material;

each stiffener of a lateral wall also having its ends in abutting relationship with and welded to members of said top and bottom walls by welding material.

5. A boom section according to claim 4 wherein said plate is substantially thinner than said members to which it is welded.

6. A boom section according to claim 4 wherein at least some of said stiffeners have a generally U-shape cross-sectional configuration.

7. A boom section according to claim 4 wherein the plate of each of said lateral wall is disposed inwardly of the members of its respective wall and the stiffeners of said respective lateral wall are disposed outwardly of the plate of said respective lateral wall.

8. A boom section according to claim 7 wherein said plate is substantially thinner than said members to which it is welded.

9. A boom section according to claim 8 wherein at least some of said stiffeners have a generally U-shape cross-sectional configuration.

10. A boom section according to claim 4 wherein said member is approximately three times as thick as said plate.

11. A high-strength light-weight hollow boom section for a telescopic crane boom comprising:

a top wall, a bottom wall, and a pair of lateral walls;

each of said wall comprising a pair of spaced apart longitudinally extending elongated members, each of said members having a pair of major surfaces and inner and outer edges;

each of said walls further comprising an imperforate plate extending between and overlapped with a major surface of said pair of members, each plate having a pair of major surfaces and spaced apart edges;

welding material disposed between a plate edge and a major surface of the member which it overlaps;

welding material disposed between an inner edge of a member and a major surface of the associate plate;

each of said walls also comprising a plurality of stiffeners longitudinally spaced apart from each other and extending transversely of said boom section, each stiffener having a side edge and spaced apart opposite ends;

each stiffener extending between and abutting the inner edges of the members of its respective wall;

welding material disposed between each stiffener end and the inner edge of its abutting member;

welding material disposed between said side edge of each stiffener and a major surface of its associated plate;

each lateral wall being disposed between said top and bottom walls in such a manner that the outer edges of its members abut the major surfaces of a member of said top and bottom walls;

welding material disposed between the members of each lateral wall and the abutting members of the respective top or bottom wall;

each stiffener for a lateral wall further extending to and abutting the major surface of a member of said top wall and said bottom wall;

and welding material disposed between each stiffener end and a major surface of its abutting elongated member.

12. In a telescopic boom:

an outer hollow boom section and an inner hollow boom section telescopically receivable therewithin;

each boom section comprising a top wall, a bottom wall, and a pair of lateral walls;

each of said walls comprising a pair of spaced apart longitudinally extending members and a plate extending between and connected to said pair of members;

said members in said top and bottom walls being horizontally disposed and the associated plates being disposed above said members; said members in said lateral walls being vertically disposed and the associated plates being disposed inwardly of said members;

each vertically disposed member of a lateral wall being connected in edge-wise abutting relationship with an associated horizontally disposed member in a top or bottom wall;

first slide pad means mounted on said inner boom section and slideably engageable with the undersides of the pair of spaced apart horizontally disposed members of said top wall of said outer boom section;

second slide pad means mounted on said outer boom section and slideably engageable with the undersides of the pair of spaced apart horizontally disposed members of said bottom wall of said inner boom section;

third slide pad means on said inner boom section and slideably engageable with the inside surfaces of the plates of said lateral walls;

and fourth slide pad means on said outer boom section and slideably engageable with the outside lateral edges of the spaced apart horizontally disposed members of said top and bottom walls of said inner boom section.

13. A boom according to claim 12 wherein said first and second slide pad means are pivotably mounted on their respective boom sections.

14. A boom according to claim 12 wherein said fourth slide pad means includes adjustment means for adjustment thereof, said adjustment means being accessible from the exterior of said outer boom sections.

15. A high-strength light-weight hollow boom section for a telescopic crane boom comprising:

a top wall, a bottom wall, and a pair of lateral walls between said top wall and said bottom wall;

each of said walls comprising a pair of spaced apart longitudinally extending members, a plate extending between and overlapping and welded to said pair of members, and a plurality of longitudinally spaced apart transversely extending stiffeners, each stiffener being welded to said plate and to said pair of members;

each member of a lateral wall being in edge-wise abutting relationship with and welded to a member of one of said top and bottom walls;

each stiffener of a lateral wall also having its ends in abutting relationship with and welded to members of said top and bottom walls;

the plate of each of said top wall and said bottom wall being disposed above the members of its respective wall and the stiffeners of said respective wall being disposed below said plate.

16. A high-strength light-weight hollow boom section for a telescopic crane boom comprising:

a top wall, a bottom wall, and a pair of lateral walls between said top wall and said bottom wall;

each of said walls comprising a pair of spaced apart longitudinally extending members, a plate extending between and overlapping and welded to said pair of members, and a plurality of longitudinally spaced apart transversely extending stiffeners, each stiffener being welded to said plate and to said pair of members;

each member of a lateral wall being in edge-wise abutting relationship with and welded to a member of one of said top and bottom walls;

each stiffener of a lateral wall also having its ends in abutting relationship with and welded to members of said top and bottom walls;

the members of one of said top wall and bottom wall being thicker than a member of said lateral wall to provide a greater moment of inertia and section modulus in the vertical direction.

* * * * *